US009522770B2

(12) United States Patent
Pichrt

(10) Patent No.: US 9,522,770 B2
(45) Date of Patent: Dec. 20, 2016

(54) DISPENSING CLOSURE

(75) Inventor: Vladislav Pichrt, Ostrov (CZ)

(73) Assignee: ISOLINE EU, S.R.O., Prague (CZ)

( * ) Notice: Subject to any disclaimer, the term of this patent is extended or adjusted under 35 U.S.C. 154(b) by 0 days.

(21) Appl. No.: 14/366,794

(22) PCT Filed: Feb. 13, 2012

(86) PCT No.: PCT/IB2012/050626

§ 371 (c)(1),
(2), (4) Date: Aug. 8, 2014

(87) PCT Pub. No.: WO2013/093650

PCT Pub. Date: Jun. 27, 2013

(65) Prior Publication Data

US 2014/0367414 A1 Dec. 18, 2014

(30) Foreign Application Priority Data

Dec. 19, 2011 (CZ) ..... 2011-25343

(51) Int. Cl.
*B65D 35/28* (2006.01)
*B65D 51/28* (2006.01)
*B65D 55/02* (2006.01)

(52) U.S. Cl.
CPC ..... *B65D 51/2835* (2013.01); *B65D 55/024* (2013.01)

(58) Field of Classification Search
CPC ..... B65D 51/2835; B65D 51/2814; B65D 55/024; B65D 51/28; B65D 51/2828; B65D 51/285; B65D 51/2871; B65D 51/2892; B65D 47/241; Y10S 215/08

(Continued)

(56) References Cited

U.S. PATENT DOCUMENTS 3,156,369 A * 11/1964 Bowes ..... B65D 51/285 206/222
3,779,372 A * 12/1973 de Lloret ..... 206/222

(Continued)

FOREIGN PATENT DOCUMENTS

HR 20080441 3/2010
JP 2009083923 4/2009

(Continued)

OTHER PUBLICATIONS

PCT Search Report and Written Opinion for PCT/IB2012/050626, completed Jul. 9, 2012.

*Primary Examiner* — Patrick M Buechner
*Assistant Examiner* — Randall Gruby
(74) *Attorney, Agent, or Firm* — Barnes & Thornburg LLP

(57) ABSTRACT

A dispensing closure with at least two dispensing-metering chambers, a piston in each chamber, and a plastic cover. The plastic cover includes a tamper-resistant lock. The bottoms of the chambers are closed with a covering foil. The chamber are in a bottom part of the closure body and extend into an upper guiding part of the closure body having guides. Cross-sections of the guides coincide with cross-sections of at least a portion of the chambers. Each piston includes a bottom face separating a content of the respective chamber. The plastic cover is rotatably mounted and includes an upper part having a lock preventing unintentional twisting-off of the plastic cover. The underside of each piston includes a plastic cutter for cutting the covering foil.

6 Claims, 4 Drawing Sheets

(58) Field of Classification Search
USPC ..... 222/80–87, 135
See application file for complete search history.

(56) References Cited

U.S. PATENT DOCUMENTS

| | | | | | |
|---|---|---|---|---|---|
| 4,785,931 | A * | 11/1988 | Weir | B65D 51/2835 | 206/222 |
| 5,123,574 | A * | 6/1992 | Poulos | 222/362 | |
| 5,431,276 | A * | 7/1995 | Lialin | B65D 51/2828 | 206/217 |
| 5,520,307 | A * | 5/1996 | Miller | G07F 11/44 | 206/459.5 |
| 5,979,647 | A * | 11/1999 | Han | B65D 51/2828 | 206/222 |
| 6,840,373 | B2 * | 1/2005 | Gibler et al. | 206/219 | |
| D510,867 | S * | 10/2005 | Uzkan | D9/504 | |
| 6,959,841 | B2 * | 11/2005 | Vlodek | 222/129 | |
| 7,748,550 | B2 * | 7/2010 | Cho | B65D 51/285 | 206/222 |
| 7,971,739 | B2 * | 7/2011 | Ammann | 215/257 | |
| 8,201,691 | B1 * | 6/2012 | Chowdhury | A61J 1/03 | 116/306 |
| 8,215,481 | B1 * | 7/2012 | Knickerbocker | 206/222 | |
| 8,376,134 | B1 * | 2/2013 | Underwood | 206/221 | |
| 8,475,856 | B2 * | 7/2013 | Sheehan | 426/115 | |
| 8,684,231 | B2 * | 4/2014 | Lane et al. | 222/129 | |
| 8,839,982 | B1 * | 9/2014 | Anderson et al. | 220/521 | |
| 9,290,309 | B1 * | 3/2016 | Pabon | A47G 19/2272 | |
| 9,296,601 | B2 * | 3/2016 | Ismail | B67D 7/22 | |
| 9,327,881 | B1 * | 5/2016 | Saranga | B65D 43/0204 | |
| 2002/0050461 | A1 | 5/2002 | Vlodek | | |
| 2005/0127075 | A1 * | 6/2005 | Smith et al. | 220/253 | |
| 2007/0074979 | A1 * | 4/2007 | Cho | 206/219 | |
| 2008/0041738 | A1 | 2/2008 | O'Donnell et al. | | |
| 2008/0202951 | A1 * | 8/2008 | Landolt et al. | 206/222 | |
| 2009/0321380 | A1 | 12/2009 | Francomano | | |
| 2010/0044377 | A1 | 2/2010 | Porter | | |
| 2010/0133275 | A1 * | 6/2010 | Phillips | B65D 7/40 | 220/270 |
| 2010/0200536 | A1 | 8/2010 | Van Den Broek et al. | | |
| 2011/0068102 | A1 * | 3/2011 | Porter | 220/212 | |
| 2012/0074003 | A1 * | 3/2012 | Sheehan | B65D 51/2857 | 206/219 |
| 2012/0168326 | A1 * | 7/2012 | Pannu | 206/219 | |

FOREIGN PATENT DOCUMENTS

| | | |
|---|---|---|
| KR | 1020090005510 | 1/2009 |
| KR | 1020090052142 | 5/2009 |
| KR | 1020090055374 | 6/2009 |
| KR | 1020100019600 | 2/2010 |
| WO | WO2008/110767 | 9/2008 |
| WO | WO2011/027177 | 9/2010 |

* cited by examiner

DISPENSING CLOSURE

CROSS-REFERENCE TO RELATED APPLICATIONS

This application is the U.S. national phase of PCT/IB2012/05026, filed Feb. 13, 2012. PCT/IB2012/050626 claims the benefit under the Paris Convention of the Dec. 19, 2011 filing date of Czech Republic utility model application PUV 2011-25343. The complete disclosures of PUV 2011-25343 and PCT/IB2012/050626 are hereby incorporated herein by this reference.

TECHNICAL FIELD

The invention relates a dispensing closure intended for metering of recipe ingredients into a bottle containing a liquid.

BACKGROUND ARTS

A number of technical solutions are known concerning a possibility of adding ingredients, particularly in powder form, into a bottle containing a liquid so that this step may be performed only by the consumer of the resulting drink himself. The bottle contains mostly unflavoured water to which a powdered mixture or a liquid syrup concentrate as a flavouring component should be later added. Such addition was performed till now with a flavouring substrate already contained in a capsule situated in said water-filled bottle, the flavouring agent from the capsule being activated by opening a covering lid, like e.g. in the Application HR20080441A2, or said powder or other substance are merely contained in a cavity of the lid whose twisting-off, pressing or unlocking allows its content to freely flow into the liquid in said bottle. Such principle is known e.g. from the documents US2009321380A1, US2010200536A1, KR20090055374A, KR20100019600A, JP2009083923A, KR 20090052142A or KR20090005510U. Individual solutions differ from each other by the process used for opening of the powder container after opening of the bottle, or they differ in the way of enclosing the powder in the lid. Some of the solutions require a bottle of special form or size for its due functioning. Solutions are also known in which the lid comprises several flavouring substance capsules, but upon their opening the whole quantity of ingredient contained is emptied without any possibility of controlling the powder quantity filled into the bottle. Above all the Korean documents representing the most similar background art cannot guarantee a complete emptying of the capsule cavity. A part of the filled substance can adhere to the capsule walls and may not pass into the bottle. The mix contained in the cavity falls freely after perforation of the diaphragm and it is not sure that the instant whole charge really enters the bottle. As it appears from the documents found, some of the closures cannot be reclosed any more again after activation of the powder ingredient and that is why such drink is suitable only for immediate drinking, and such bottle with the rest of the drink cannot be safely transported without a risk of spilling. The inner mechanical systems of the lids are complicated assemblies and thence their prime cost may adversely affect the final product price. The flavouring intensity cannot be adapted by controlling the quantity of filled flavouring agent, and for lids with a special bottle form it is impossible to buy only a lid with flavouring agents and to use it on one's own commonly used bottle.

DISCLOSURE OF INVENTION

A dispensing closure comprising a closure body with metering chambers according to the present invention whose principle is in that the dispensing closure body has in its bottom part at least two chambers passing into an upper guiding part of the body having a form of guides, the cross-section of which coincides with the chamber cross-sections in the transition point. In each of the chambers a piston is situated, having in its upper part a lock preventing an unintentional twisting-off of the plastic cover, and on its bottom part the piston is fitted with a plastic cutter for perforation of the covering foil. The body containing the pistons is sheltered from upside by a rotationally fitted plastic cover featuring a separable lock preventing any intervention. The chambers are closed from body downside with a covering foil. The chambers of the dispensing closure are formed in the form of and equal-armed triangle, the longest side of which has a form of a circular sector. The dispensing closure has a piston which is hollow in the direction from the piston circular side towards the centre. The dispensing closure has a separable lock preventing any intervention, fitted with an attachment ring. The dispensing closure has a plastic cutter of the piston shaped as an extension of the circular edge of the piston.

As compared with the background art, the dispensing closure according to the present invention yields several advantages. One of them is in that the dispensing closure enables a multiple use with various flavouring substances. It may be independently used with a bottle which was already emptied. This yields an environmental saving and a lower environment contamination with plastics. When transporting, e.g. on a leave, only one bottle and several closures requiring less space may be transported. The closure chambers can be filled with powder, liquid mixes or even with pills, because it is guaranteed that the content will be expelled into the liquid contained in the bottle with no rest adhering to the chamber walls.

BRIEF DESCRIPTION OF DRAWINGS

The invention will be explained in detail on attached drawings, in which represent.

MADE FOR CARRYING OUT THE INVENTION

Figure 1:
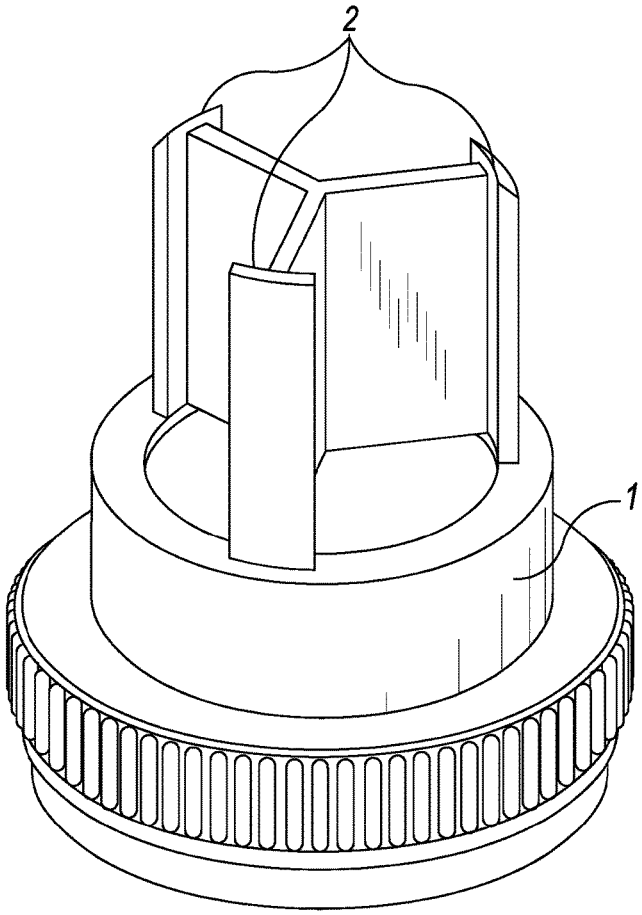
FIG. 1 a dispensing closure body with thread for a bottle and with guides for pistons FIG. 2 a bottom view of flavouring compound chambers FIG. 3 the complete dispensing closure assembly including plastic cover.
Figure 2:
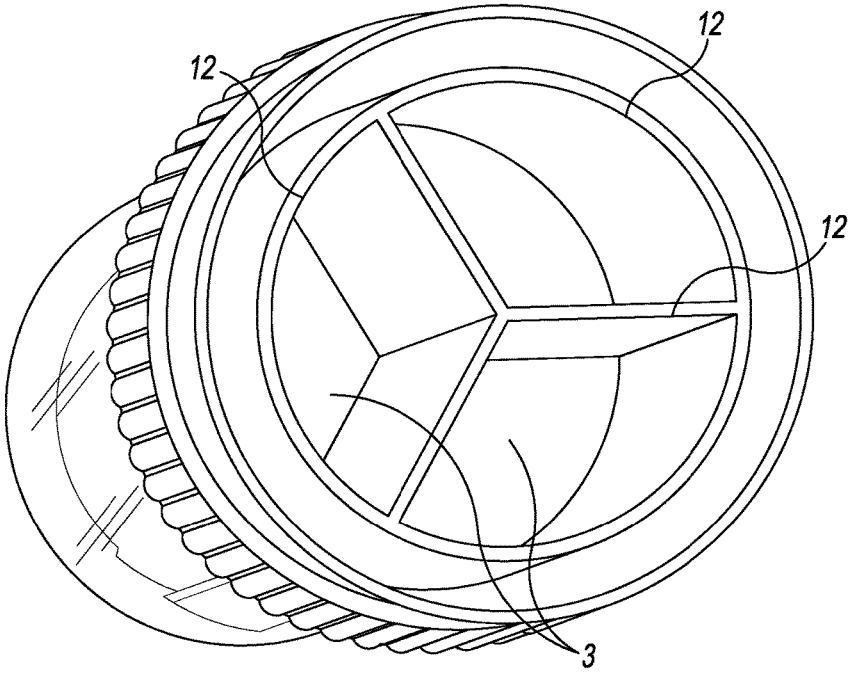

The dispensing closure is designed so that it includes a body 1 which has three chambers 3 passing into an upper guiding part of the body 1 having a form of guides 2, the cross-section of which coinciding with the cross-sections of the chambers 3 in the transition point. In each of the chambers 3 a piston 4 is situated. On its upper part, each piston 4 has a lock 7 preventing unintentional twisting-off of the plastic cover 5. On its bottom part the piston 4 is fitted with a plastic cutter 10 for perforation of the covering foil 6. The body 1 containing the pistons 4 is sheltered from upside with a rotationally fitted plastic cover 5 featuring a separable lock 7 preventing any intervention. The chambers 3 are closed from downside of the body 1 with a covering foil 6. As shown in FIG. 2, each chamber 3 of the dispensing closure is formed in the form of an equal-armed triangle 12, the longest side of which is in a form of circular sector. The piston 4 is hollow in the direction from the circular side of the piston 4 towards the center. The separable lock 7 is fitted with an attachment ring 14. The plastic cutter of the piston 4 is shaped as an extension 16 of the circular edge of the piston 4.

Figure 3:
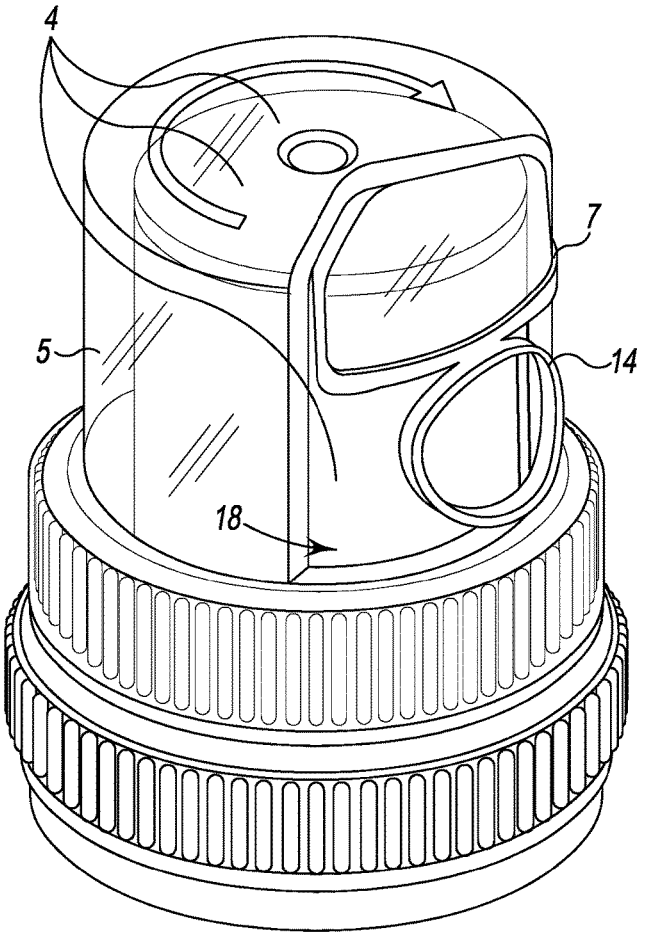
Figure 4:
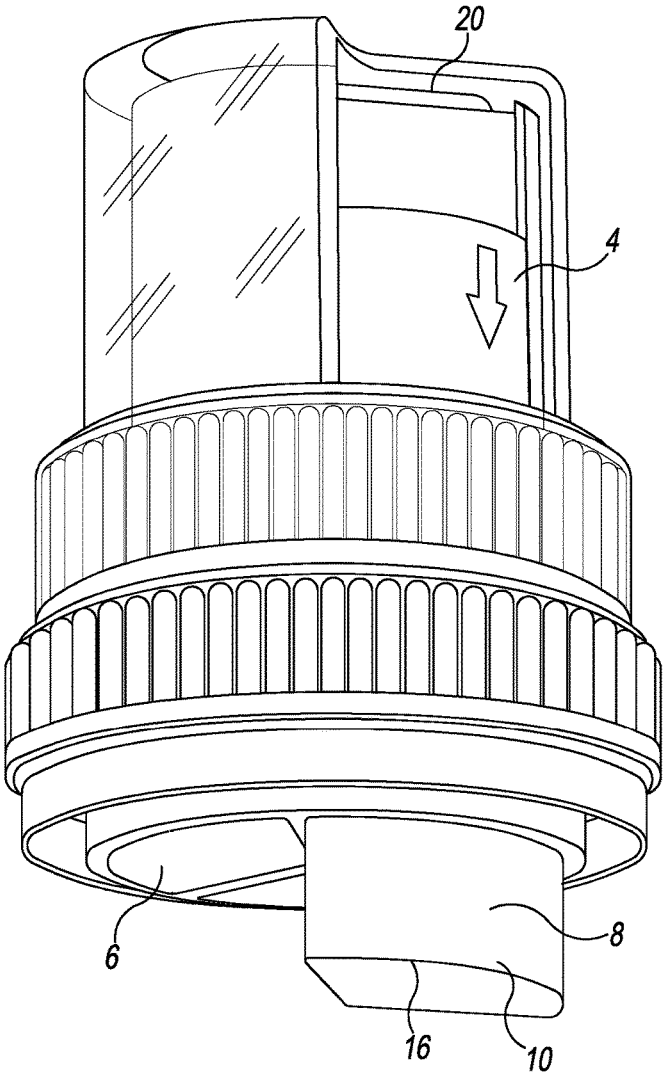
FIG. 4 shows the process of discharging the flavouring compound by a stroke of the piston.

The dispensing closure is filled so that the chambers 3 in inverted position, bottom upside, are filled with required flavouring matter and are closed with aluminium foil 6. The dispensing closure with locking ring is then screwed upon the bottle and the latter is so locked against unintentional opening. Using a part of the plastic cover 5 with the separable lock 7, the access to one of the three pistons 4 is made through an opening 18 after pulling free the separable lock 7. By twisting of the opening 18 in the plastic cover 5 the required component of flavour in a chamber 3 is selected and the plastic cover 5 prevents access to the other chambers 3, as shown in FIG. 3. When turning the plastic cover 5 clockwise a step 20 (see FIG. 4) on the piston 4 is crossed, representing a lock against unintentional twisting of the plastic cover 5. By pushing on piston 4 carrying the plastic cutter located on the annular cutting edge of the piston 4 the covering foil 6 below the selected piston 4 is perforated and the content 8 of the chamber 3 is discharged into the bottle on which the dispensing closure has been fitted. After emptying of the bottle the dispensing closure is screwed free, the bottle is filled with fresh water again and the dispensing closure can be screwed on. So it is possible to use the dispensing closure for so many bottle fillings how many chambers 3 the dispensing closure contains. The dispensing closure has been designed for a 38 mm thread bottle.

INDUSTRIAL APPLICABILITY

The dispensing closure for metering flavouring components into bottles according to the present invention can be used for any kind of drinking needs, while the final consumer can prepare his drink as to the taste and quantity at his own will for himself. It finds therefore application in the beverage branch of the food industry.

I claim:

1. A dispensing closure comprising a closure body (1) with at least two dispensing-metering chambers (3), and a piston (4) situated in each of the chambers (3), wherein the closure body (1) containing the pistons (4) has an upper side closed by a plastic cover (5), the plastic cover (5) including a separable, tamper-resistant lock (7), the bottoms of the chambers (3) being closed with a covering foil (6), the at least two chambers (3) being situated in a bottom part of the closure body (1) and extending into an upper guiding part of the closure body (1) having a form of guides (2), cross-sections of which coincide with cross-sections of at least a portion of the chambers (3), wherein the plastic cover (5) is rotatably mounted on the closure body and includes an upper part including the lock (7) and an opening defined therein, and when the plastic cover is rotated to a first position on the closure body, the opening is sized to permit access to one of the pistons situated in one of the chambers, and the plastic cover prevents access to another piston situated in another chamber, and wherein the underside of each piston (4) includes a plastic cutter for cutting the covering foil (6).

2. The dispensing closure according to claim 1 wherein the closure body (1) comprises three chambers (3).

3. The dispensing closure according to claim 2 wherein cross-sections of the chambers (3) are equal-armed triangles.

4. The dispensing closure according to claim 1 wherein the piston (4) is hollow.

5. The dispensing closure according to claim 1 wherein the separable lock (7) is fitted with an attachment ring.

6. The dispensing closure according to claim 1 wherein the plastic cutter of the piston (4) comprises an extension of a circular edge of the piston (4).

* * * * *